US010480153B2

(12) United States Patent
Belesimo

(10) Patent No.: US 10,480,153 B2
(45) Date of Patent: Nov. 19, 2019

(54) SLOPE-LEVEL-CUT BUCKET

(71) Applicant: CASHMAN DREDGING AND MARINE CONTRACTING, CO., LLC, Quincy, MA (US)

(72) Inventor: Frank Belesimo, Easton, MA (US)

(73) Assignee: Cashman Dredging and Marine Contracting, Co., LLC, Quincy, MA (US)

( * ) Notice: Subject to any disclaimer, the term of this patent is extended or adjusted under 35 U.S.C. 154(b) by 0 days.

(21) Appl. No.: 16/361,366

(22) Filed: Mar. 22, 2019

(65) Prior Publication Data

US 2019/0292746 A1 Sep. 26, 2019

Related U.S. Application Data

(60) Provisional application No. 62/647,176, filed on Mar. 23, 2018.

(51) Int. Cl.
*E02F 3/40* (2006.01)

(52) U.S. Cl.
CPC ..... *E02F 3/404* (2013.01)

(58) Field of Classification Search
CPC ..... E02F 3/404; E02F 3/413; E02F 3/4131; E02F 3/4133; E02F 3/4135; E02F 3/4136; E02F 3/4138; B66C 3/02; B66C 3/04; B66C 3/005; B66C 3/12
See application file for complete search history.

(56) References Cited

U.S. PATENT DOCUMENTS 813,528 A * 2/1906 Slocum ..... B66C 3/12 37/188
925,262 A * 6/1909 Allen ..... B66C 3/12 37/188
1,864,793 A * 6/1932 Botten ..... B66C 3/02 37/184
2,405,811 A * 8/1946 Beyer ..... A47L 13/52 15/236.01
2,594,720 A * 4/1952 Beck, Jr. ..... E02F 3/4136 37/184
2,660,323 A * 11/1953 Carlesimo ..... E02F 3/40 37/444
2,753,978 A * 7/1956 Kerr ..... E02F 3/147 198/704
2,828,038 A * 3/1958 Dorkins ..... E02F 3/306 37/187
3,032,900 A * 5/1962 Kashergen ..... E02F 3/40 37/445
3,187,916 A * 6/1965 O'Leary ..... E02F 3/4136 294/68.23
3,252,606 A * 5/1966 Pryor ..... E02F 3/4133 37/184

(Continued)

*Primary Examiner* — Jamie L McGowan
(74) *Attorney, Agent, or Firm* — Jacob M. Ward; Ward Law Office LLC

(57) ABSTRACT

A slope-level-cut bucket for an excavator includes a first bucket half and a second bucket half. The bucket halves are pivotably connected to each other and movable between a closed position and an opened position. Each bucket half has an excavating edge configured to minimize bucket overlap during cutting of a sloped surface. In particular, the excavating edge includes a plurality of steps. The dimensions of the steps are selected to optimize the cutting of a desired slope of the excavating surface.

15 Claims, 6 Drawing Sheets

(56) References Cited

U.S. PATENT DOCUMENTS 3,516,183 A * 6/1970 Serota ..... E02F 3/4136 175/162
3,574,384 A * 4/1971 Bellart ..... E02F 3/413 294/68.23
3,737,059 A * 6/1973 Peterson ..... E02F 3/404 37/184
3,881,263 A * 5/1975 Coeurderoy ..... E02F 3/3681 37/186
3,958,347 A 5/1976 Heitman
3,975,044 A * 8/1976 Briggs ..... B66C 3/125 294/68.23
4,037,337 A * 7/1977 Hemphill ..... E02F 3/3604 37/444
4,047,313 A * 9/1977 Bricon ..... B66C 3/16 37/187
4,123,861 A * 11/1978 Hemphill ..... E02F 3/40 37/195
4,124,243 A * 11/1978 Raffin ..... B66C 3/16 294/68.23
4,143,901 A * 3/1979 van Huuksloot ..... B66C 3/02 294/68.23
4,176,872 A * 12/1979 van Huuksloot ..... B66C 3/02 294/68.23
4,283,866 A * 8/1981 Ogawa ..... E02F 3/404 37/406
4,314,789 A 2/1982 Luigi
4,616,433 A * 10/1986 Knell ..... E02F 3/40 172/777
4,776,524 A * 10/1988 Sakato ..... E01C 23/122 241/101.73
4,799,852 A * 1/1989 Ramun ..... E02F 3/404 37/406
4,896,444 A 1/1990 Sieber et al.
5,016,365 A * 5/1991 Robinson ..... E02F 3/40 37/451
5,084,990 A * 2/1992 Briscoe ..... E02F 3/60 37/398
5,649,377 A * 7/1997 Tanada ..... E02F 3/3681 37/406
5,836,089 A * 11/1998 Lipsker ..... B66C 3/02 37/186
6,328,114 B1 * 12/2001 Ritchie ..... A01B 13/00 172/445.1
6,453,586 B1 * 9/2002 Wolin ..... B66C 3/16 37/406
6,523,284 B1 * 2/2003 Clugston ..... E02F 3/404 172/250
7,191,553 B2 * 3/2007 Doucette ..... E02F 3/3681 37/379
7,484,323 B2 * 2/2009 Morin ..... E02F 3/40 37/404
7,617,619 B2 * 11/2009 Cox ..... E02F 3/404 37/406
7,739,815 B2 * 6/2010 Horton ..... E02F 3/8152 37/404
8,135,280 B2 3/2012 Zong et al.
8,464,972 B2 * 6/2013 Nye ..... E02F 3/965 241/101.73
8,628,035 B2 * 1/2014 Ramun ..... E02F 3/965 241/101.73
8,628,053 B2 1/2014 Marechal
8,727,252 B1 * 5/2014 Phipps ..... E02F 3/965 241/101.73
9,252,620 B2 2/2016 Yamauchi et al.
9,469,975 B2 * 10/2016 Sheehan ..... E02F 9/2883
10,252,892 B2 * 4/2019 de Kluijver ..... B66C 3/12
2004/0148820 A1 * 8/2004 Horton ..... E02F 5/32 37/411
2010/0115801 A1 5/2010 Doucette et al.

* cited by examiner

SLOPE-LEVEL-CUT BUCKET

CROSS REFERENCE TO RELATED APPLICATIONS

This application claims the benefit of U.S. Provisional Application 62/647,176, filed on Mar. 23, 2018. The entire disclosure of the above application is hereby incorporated herein by reference.

FIELD

The present disclosure relates to excavator buckets and, more particularly, to an excavator bucket for minimizing bucket overlap and maintaining accuracy on sloped surfaces.

BACKGROUND

Excavators are typically used in construction and reclamation or cleanup projects for the grading of land and dredging operations. Known excavators will have a clamshell bucket mounted to the end of a stretchable arm. The stretchable arm is normally defined by a two-member linkage. One of the linkages, called a boom, is pivotally mounted to a machine base of the excavator, and extends outwardly in an upward direction. The other linkage, called a stick arm, is pivotally mounted at one end to the outer end of the boom and extends downwardly from a boom pivot. Normally, the clamshell bucket is pivotally mounted to the outer end of the stick arm.

In operation, hydraulic cylinders of the excavator are typically used to move the boom, the stick, and the bucket independently under the control of an operator or a machine control system. The clamshell bucket itself is openable and closable by means of fluid pressure applied by a hydraulic cylinder. Another hydraulic cylinder may be used to rotate the machine base relative to a set of tracks. This permits a repositioning of the clamshell bucket for operations like cutting of the land and dumping to a desired location.

Most excavating projects involve creating surfaces that are substantially planar, either horizontal or sloped. Operating an excavator efficiently requires a skilled operator, especially when the excavator is being used to excavate sloped surfaces. Operator skill is especially critical because the couplings between the machine base, boom, stick arm, and bucket are pivots, and therefore extending or retracting any single hydraulic cylinder or actuator causes the digging edge of the bucket to move in an arc. The clamshell bucket will also usually have a rectangular-shaped footprint. For these reasons, excavating operations for the formation of sloped surfaces usually require approaching the surface to be excavated from suitable locations relative to the sloped surface, and precise use of the clamshell bucket.

However, even with the most skilled operators, use of conventional clamshell buckets has been found to result in an undesirable degree of bucket overlap when cutting a sloped surface. This is wasteful and not environmentally sensitive. Maintaining the optimal orientation of the bucket to the sloped surface with conventional clamshell buckets has also proven difficult, especially with the rectangular-shaped footprint associated with conventional clamshell buckets.

There is also a particular need for a clamshell bucket to meet the stringent requirements associated with environmental dredging. Such environmental dredging work includes the removal of polychlorinated biphenyl (PCB) contaminated sediment, transportation of sediment, and disposal of the sediment into an existing Confined Aquatic Disposal (CAD) cell. The bucket required position accuracy for such projects is +/− four (4) inches vertically and +/− six (6) inches horizontally. The work is required to be conducted in a two-pass approach. The first pass removes the material up to one (1) foot above the required design. The second pass removes the final one (1) foot of material to the required design. The dredging is also required to be conducted from the top-down (shallow to deep) in order to minimize residuals.

There is a continuing need for an excavator bucket that facilitates the cutting of a sloped surface, and minimizes bucket overlap when cutting the sloped surface. Desirably, the excavator bucket also permits the maintenance of a predetermined orientation of the bucket to the sloped surface and allows for compliance with stringent environmental dredging requirements.

SUMMARY

In concordance with the instant disclosure, an excavator bucket that facilitates the cutting of a sloped surface, minimizes bucket overlap when cutting the sloped surface, which permits the maintenance of a predetermined orientation of the bucket to the sloped surface, and which allows for compliance with stringent environmental dredging requirements, is surprisingly discovered.

In one embodiment, a slope-level-cut bucket has a first bucket half pivotably connected to a second bucket half. The first bucket half and the second bucket half are movable about a first axis between a closed position and an opened position. Each of the first bucket half and the second bucket half have a top wall, a front wall, a rear wall, a side wall and a cutting wall. The cutting wall has a plurality of steps. The first bucket half and the second bucket half have a rim defined by the top wall, the front wall, the rear wall, and the cutting wall. The rim of each cutting wall defines an excavating edge of the respective bucket half.

In another embodiment, the rear wall of each of the first bucket half and the second bucket half is on a first plane, and the excavating edge of the first bucket half is on a second plane. The first plane is oriented transverse to the second plane, defining a first angle therebetween. The first angle is between about 72 degrees and about 79 degrees. A planar surface of the side wall of each of the first bucket half and the second bucket half is on a third plane and the top wall of each of the first bucket half and the second bucket half is on fourth plane. The third plane is oriented transverse to the fourth plane, defining a second angle therebetween. The second angle between about 25 degrees and about 45 degrees.

In a further embodiment, the first bucket half and the second bucket half each have a distal end and a proximal end. The side wall and the cutting wall of the first bucket half and the second bucket half each taper toward the distal end of their respective bucket half.

DRAWINGS

The above, as well as other advantages of the present disclosure, will become readily apparent to those skilled in the art from the following detailed description, particularly when considered in the light of the drawings described hereafter.

DETAILED DESCRIPTION

The following description is merely exemplary in nature and is not intended to limit the present disclosure, application, or uses. In respect of the methods disclosed, the order of the steps presented is exemplary in nature, and thus, is not necessary or critical unless otherwise disclosed.

In FIGS. 1-10, an excavating slope-level-cut bucket 2 according to various embodiments of the present disclosure is shown. The slope-level-cut bucket 2 is provided in the form of a clamshell having a first bucket half 4 and a second bucket half 6. The first bucket half 4 and the second bucket half 6 described herein mirror one another, and so description provided herein of structure relative to the first bucket half 4 applies equally to description of structure of the second bucket half 6.

Figure 3:
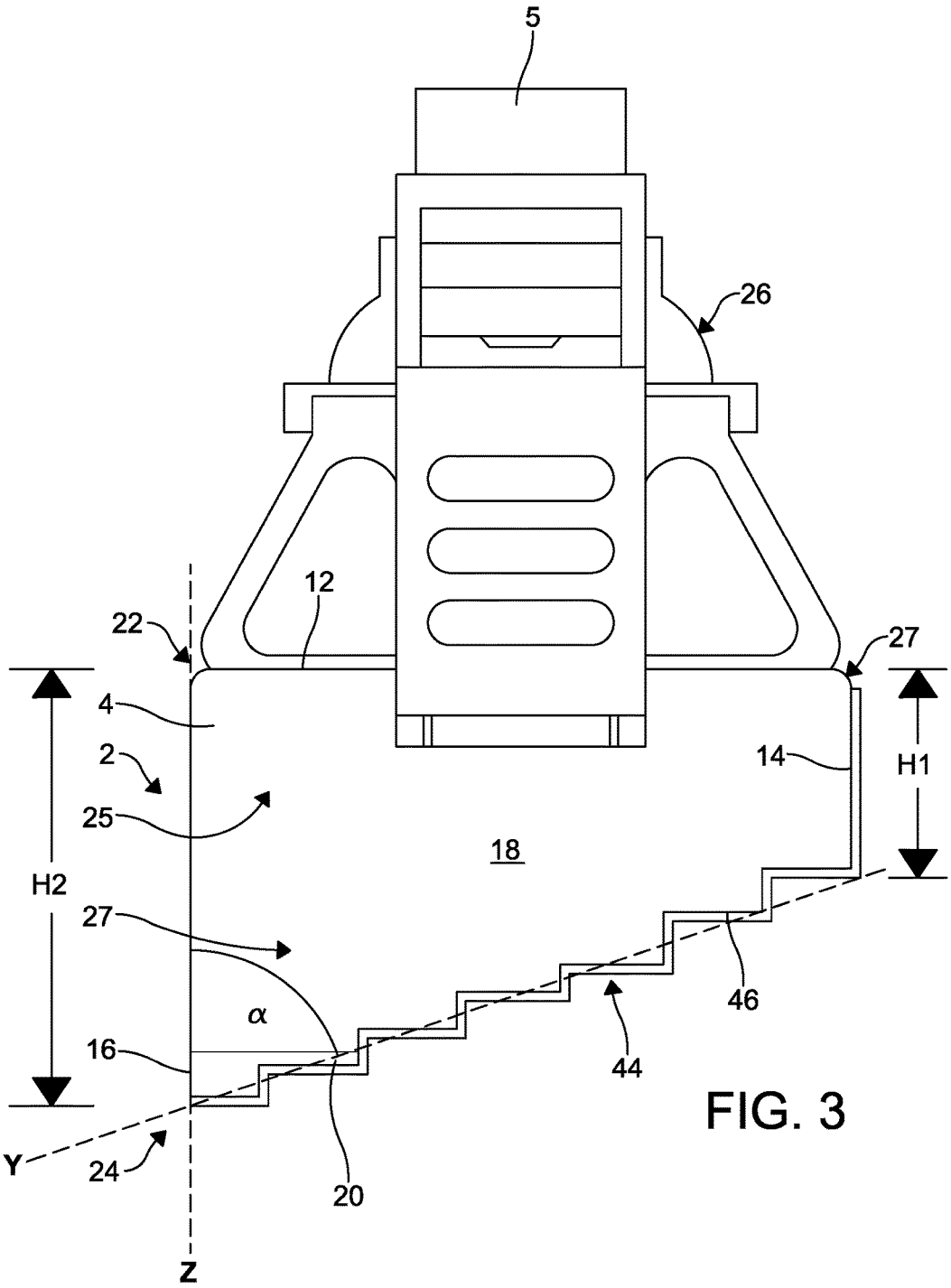
FIG. 3 is a left side elevational view of the slope-level-cut bucket shown in FIG. 2.
Figure 4:
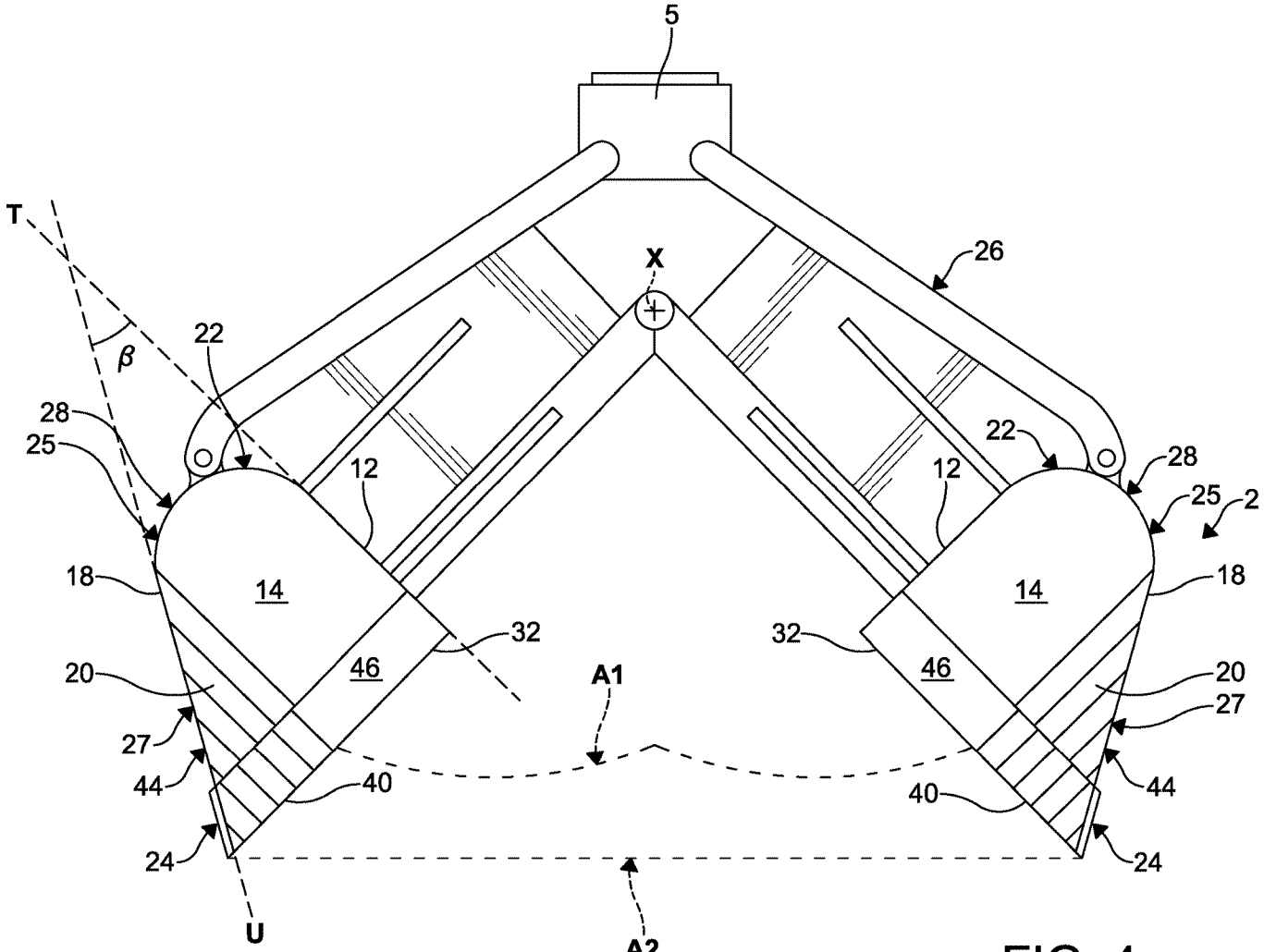
FIG. 4 is a front elevational view of the slope-level-cut bucket shown in FIG. 1, with dashed lines indicating an arc of movement of the bucket halves in operation moving from the opened position to the closed position.
Figure 5:
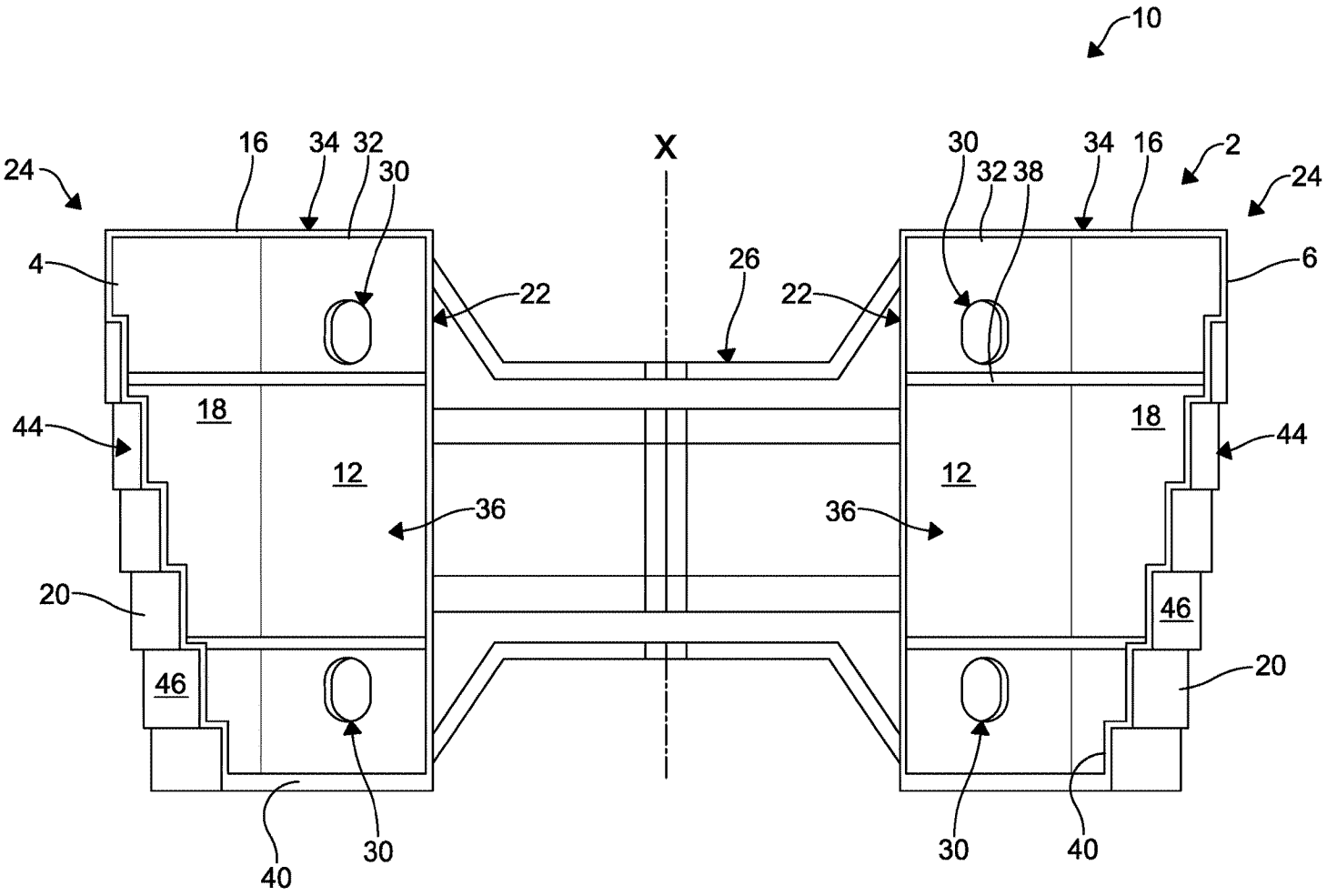
FIG. 5 is a bottom plan view of the slope-level-cut bucket shown in FIG. 1.

As shown in FIGS. 1-5, The first bucket half 4 and the second bucket half 6 are pivotably connected to one another. For example, the first bucket half 4 and the second bucket half 6 may be movable about a first axis X by an actuator 5, as shown in FIGS. 4 and 5. In particular, the first bucket half 4 and the second bucket half 6 are moveable between a closed position (shown in FIGS. 2-3) and an opened position (shown in FIGS. 1 and 4-5).

As a non-limiting example, the actuator 5 may be a hydraulic actuator in communication with a controller (not shown) used by an operator of the bucket 2. However, other suitable types of actuators 5 including electric and pneumatic actuators are also contemplated and considered within the scope of the present disclosure.

In certain embodiments, as shown in FIGS. 1-5, the first bucket half 4 and the second bucket half 6 may be bilaterally symmetrical in shape. Each bucket half 4, 6 may have a top wall 12, a front wall 14, a rear wall 16, a side wall 18 and a cutting wall 20. In particular embodiments, the top wall 12, the front wall 14, and the rear wall 16 may each be substantially planar. The top wall 12 may be oriented transverse to the front wall 14 and the rear wall 16 and connect the front wall 14 to the rear wall 16. In particular embodiments, the top wall 12 may be oriented substantially orthogonal to the front wall 14 and the rear wall 16. The front wall 14 may also be substantially parallel with the rear wall 16. The front wall 14 may be disposed between the side wall 18, the top wall 12 and the cutting wall 20. The rear wall 16 may be disposed between the side wall 18 and the top wall 12. The cutting wall 20 may be disposed between the side wall 18 and the top wall 12.

With continued reference to FIGS. 1-5, the bucket halves 4, 6 may each have a proximal end 22 and a distal end 24. The proximal end 22 of the bucket half 4, 6 may be attached to a support structure 26. The support structure 26 pivotably connects the first bucket half 4 and the second bucket half 6.

In certain embodiments, the cutting wall 20 and the side wall 18 of each bucket half 4, 6 may taper toward the distal end 24. Also, the side wall 18 of the bucket half 4, 6 may have both a curvilinear surface 25 and a planar surface 27. The curvilinear surface 25 is disposed adjacent the proximal end 22 of the bucket half 4, 6 and the planar surface 27 is disposed adjacent the distal end 24. In certain embodiments, each bucket half 4, 6 may also have rounded corners 28 defined by a portion of the curvilinear surface 25 adjacent to and disposed between the top wall 12 and the side wall 18.

Figure 1:
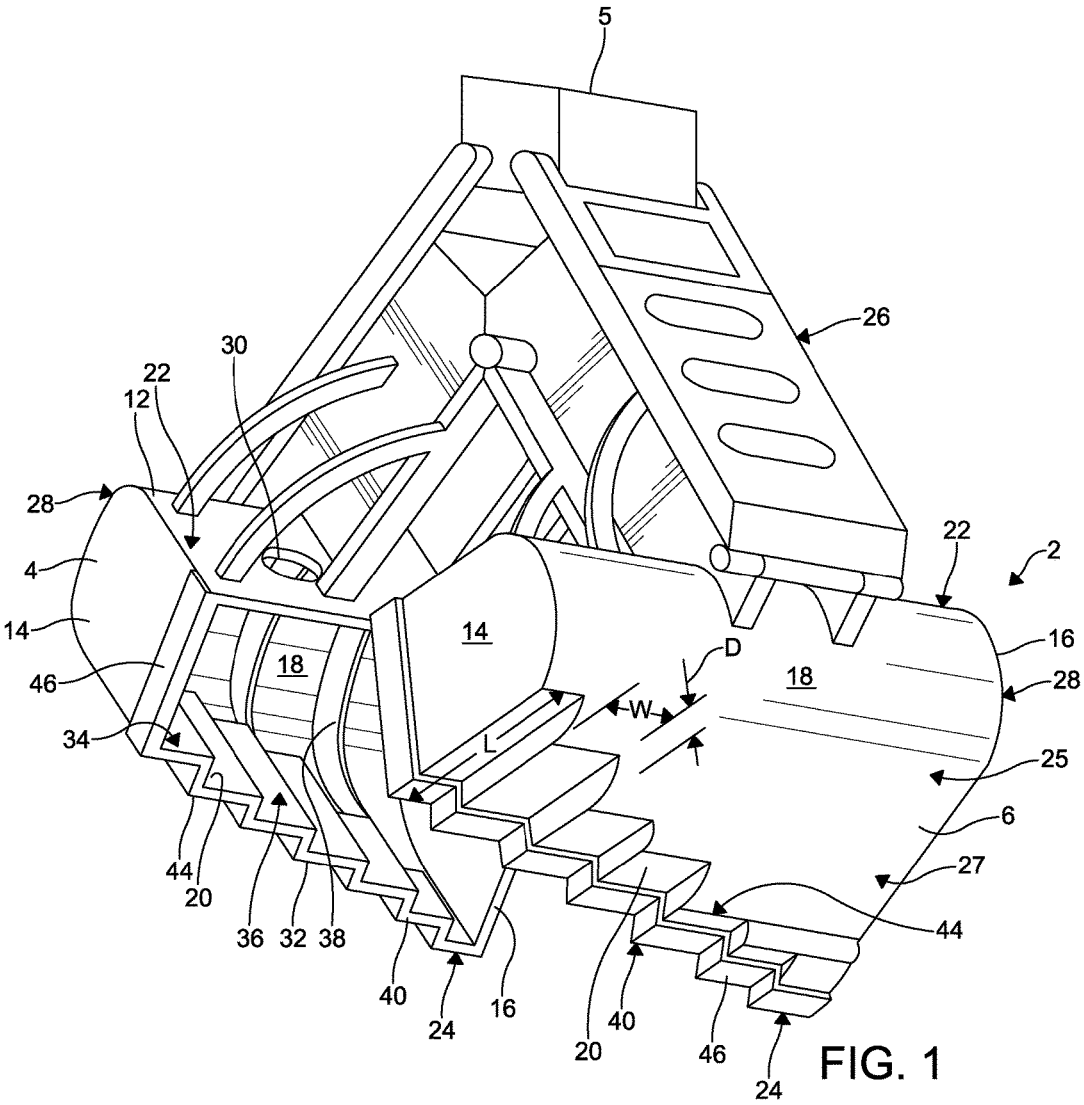
FIG. 1 is a top perspective view of a slope-level-cut bucket according to one embodiment of the disclosure, the bucket depicted in an opened position.
Figure 2:
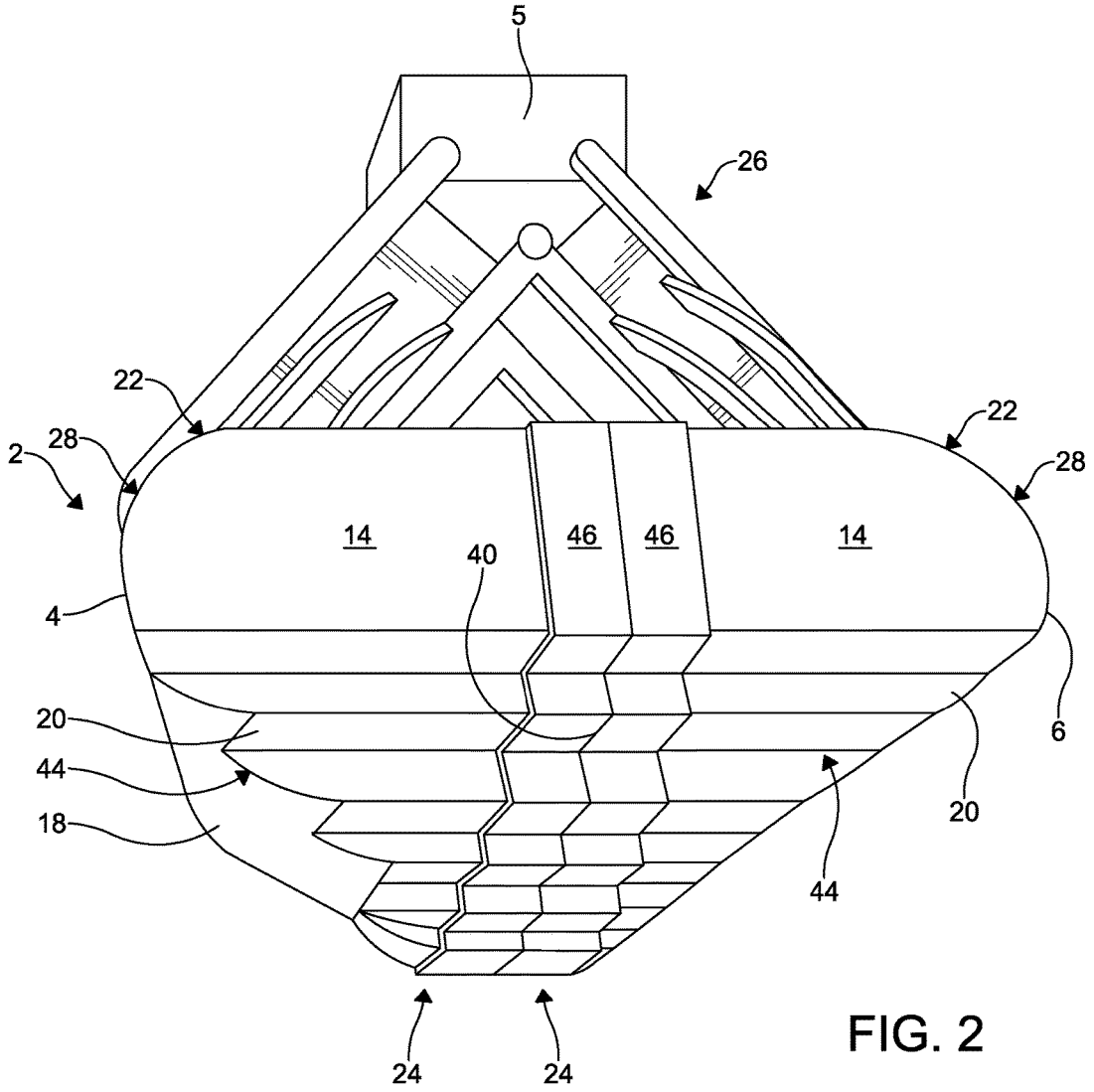
FIG. 2 is a bottom perspective view of the slope-level-cut bucket shown in FIG. 1, the bucket depicted in a closed position.

With reference to FIGS. 1 and 5, the top wall 12 may have at least one de-watering aperture 30 formed therein. The at least one de-watering aperture 30 allows for water to be discharged from the slope-level-cut bucket 2 in operation, where the slope-level-cut bucket 2 is used for dredging or removing material from an aqueous environment. The location, shape, and size of the at least one de-watering aperture 30 also militates against material undesirably falling out of each bucket half 4, 6. For example, as shown in FIG. 5, each top wall 12 may have two of the de-watering apertures 30 that are generally ovoidal in shape and centrally located in the top wall 12. A skilled artisan may include any other number of de-watering apertures 30 in the slope-level-cut bucket 2, having any other suitable shapes, sizes, and locations, as desired.

With further attention to FIG. 5, each bucket half 4, 6 may also have a rim 32 that is defined by the top wall 12, the rear wall 16, the front wall 14, and the cutting wall 20. The rim 32 of each bucket half 4, 6 is configured to be disposed closely adjacent to, or abut, the rim 32 on the opposite bucket half 4, 6 where the slope-level cut bucket 2 is in the closed position. The rim 32 further defines an opening 34 in the first bucket half 4 and the second bucket half 6. The opening 34 is in communication with a cavity 36 in each of the first bucket half 4 and the second bucket half 6, where the cavity 36 is defined by inner surfaces of the top wall 12, the rear wall 16, the front wall 14, the side wall 18, and the cutting wall 20. In particular embodiments, the cavity 36 of the first bucket half 4 may be of the same volume as the cavity 36 of the second bucket half 6. It should be appreciated that the cavity 36 is adapted to receive and hold excavated material, where the slope-level-cut bucket 2 is in the closed position.

In certain embodiments, also shown in FIG. 5, each bucket half 4, 6 may have at least one support rib 38. The at least one support rib 38 is disposed within the cavity 36 between the cutting wall 20 and the top wall 12. The at least one support rib 38 is adapted to optimize a rigidity of the slope-level-cut bucket 2. Other suitable internal or external structures for enhancing a rigidity of the slope-level-cut bucket 2 may also be employed within the scope of the disclosure.

Figure 8:
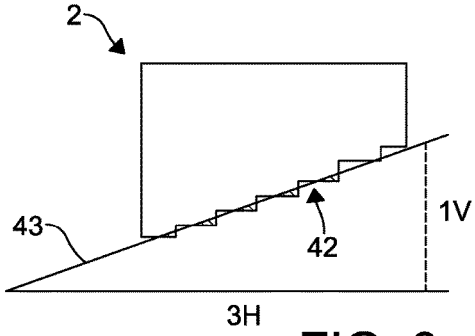
FIG. 8 is a schematic illustration showing a cutting of a 3H:1V slope with the slope-level-cut bucket shown in FIGS. 1-5.
Figure 9:
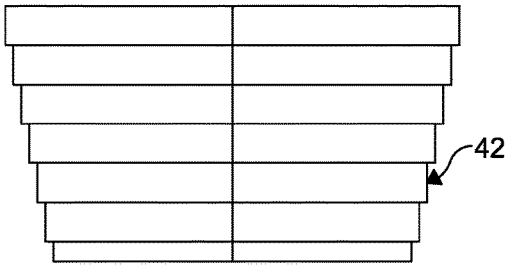
FIG. 9 is a schematic illustration showing a top plan view of a cutting bite of the slope-level-bucket shown in FIGS. 1-5, illustrating a single bucket's interaction with a bottom.

With renewed reference to FIGS. 1 and 5, the rim 32 of the cutting wall 20 may form an excavating edge 40 on each bucket half 4, 6. In particular, as shown in FIGS. 6-9, the excavating edge 40 of the slope-level-cut bucket 2 is configured create a contoured cutting footprint 42, as opposed to a rectangular cutting footprint that is generally associated with conventional buckets. For example, the contoured cutting footprint may be trapezoidal in shape, as shown in FIG. 9. Each of the excavating edges 40 is also shaped in a configuration designed to optimize a cutting of the desired slope angle of an excavating surface 43, also shown in FIGS. 6-8.

Referring now to FIG. 3, the front wall 14 may have a height H1 that is different than a height H2 of the rear wall 16. For example, the height H1 of the front wall 14 may be less than the height H2 of the rear wall 16. It should be appreciated that the different between the height H1 and the height H2 allows the cutting wall 20 to be generally oriented at a predetermined or desired angle α, which in turn permits for the cutting of a particular slope of the excavating surface 43.

Figure 6:
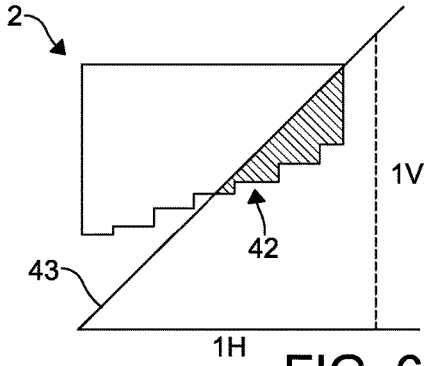
FIG. 6 is a schematic illustration showing a cutting of a 1H:1V slope with the slope-level-cut bucket shown in FIGS. 1-5.
Figure 7:
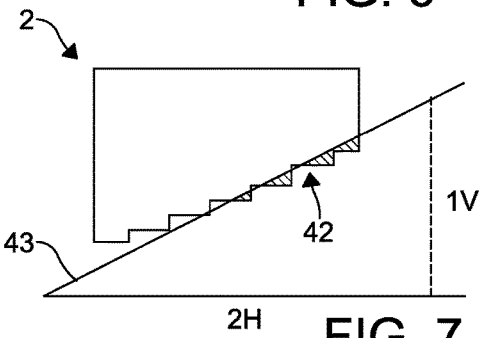
FIG. 7 is a schematic illustration showing a cutting of a 2H:1V slope with the slope-level-cut bucket shown in FIGS. 1-5.

In certain embodiments, a contour of the cutting wall 20 may be selected so as to be optimized for creation of differently angled slope cuts in the excavating surface 43. For example, as shown in FIGS. 6-8, the slope may be calculated by comparing the horizontal distance (H) to the vertical distance (V) of an excavatable material.

With reference to FIG. 3, and in order to create the desired angled slope cut, the steps 44 defining the excavating edge 40 of the cutting wall 20 may be oriented generally along a plane Y and the rear wall 16 may be generally oriented along a plane Z. Plane Y may be transverse to plane Z and form an angle α therebetween. The angle α may be selected in order to create the desired slope of the excavating surface 43 being cut.

For example, the excavating edge 40 of each bucket half 4, 6 may be adapted to create a 5H:1V slope (not shown, where the angle α is about 79 degrees), a 4H:1V slope (not shown, where the angle α is about 76 degrees); or a 3H:1V slope (shown in FIG. 8, where the angle α is about 72 degrees), as non-limiting examples. Other suitable angles α may also be selected by a skilled artisan for the excavating edge 40 of the bucket half 4, 6, as desired.

In particular embodiments, the cutting wall 20 of the bucket half 4, 6 has a plurality of steps 44, which in turn define the contour of the excavating edge 40 of the bucket half 4, 6. As shown in FIG. 1, each of the steps 44 may have at least one of a different length (L), a different width (W), and a different depth (D), which may each be selected by one skilled in the art based on the desired slope of excavation. For example, the length (L) of each of the steps 44 defines a length of an associated portion of the cutting wall 20 where the step 44 is located, between the planar surface 27 of the side wall 18 and the excavating edge 40 of the rim 32. The length (L) of the steps 44 adjacent to the front wall 14 may be greater than the length (L) of the steps 44 that are adjacent to the rear wall 16. It should be appreciated that the length (L), the width (W), and the depth (D) of the steps 44 take into account both the desired slope to be cut, and also an arc motion resulting from a movement of the slope-level-cut bucket 2, for example, as shown in FIG. 4.

Furthermore, it should be understood that the use of discrete steps 44 also provides better cutting performance than a continuous, uninterrupted curved edge, as the stepped 44 excavating edge 40 has been found to better hold in material having been cut from the excavating surface 43, where the bucket is in the closed position. The length (L), the width (W), and the depth (D) of each of the steps 44 may be selected by the skilled artisan to correspond with the desired end use of the slope-level-cut bucket 2, within the scope of the present disclosure. For example, the slope-level-cut bucket 2 may have seven (7) steps formed in the cutting wall 20 that are configured to be of the length (L), the width (W), and/or the depth (D) to create a 3H:1V slope cut in the excavating surface 43, for example, as shown in FIG. 8.

With renewed reference to FIGS. 1-5, in particular embodiments, the cutting wall 20 of the slope-level-cut bucket 2 may have a reinforcing portion 46 secured to the cutting wall 20. The reinforcing portion 46 may further strengthen the excavating edge 40 of the cutting wall 20, which is adapted to remove material from the excavating surface 43. A terminal edge of the reinforcing portion 46 may be substantially flush or even with the excavating edge 40 of the cutting wall 20, thereby creating a continuous cutting edge surface. It should be appreciated that the reinforcing portion 46 militates against the degradation of the excavating edge 40, for example, by undue bending, chipping, or cutting, thereby optimizing the longevity of the slope-level-cut bucket 2 in operation.

In certain embodiments, as shown in FIGS. 1 and 4, the steps 44 disposed adjacent to the front wall 14 of the bucket halves 4, 6 may close in a first arc A1, and the steps 44 adjacent to the rear wall 16 of the bucket halves 4, 6 may close in a second arc A2. For example, the excavating edge 40 of the steps 44 adjacent to the rear wall 16 of each bucket half 4, 6 is configured to create a level arc A2, while the excavating edge 40 of the steps 44 adjacent to the front wall 14 close in a set of curved arcs A1. The curved arcs A1, formed during the closing of the bucket by the steps 44 enables the steps 44 to cut deeper into the excavating surface 43 and force the material outward into the cavities 34 of each bucket half 4, 6. In this way, the curved cutting action of the steps 44 disposed closest to the front wall 14 function to remove a greater amount of material, while securing the material within each bucket half 4, 6.

In particular embodiments, with further reference to FIG. 4, the planar surface 27 of the side wall 18 may be on a plane U and the top wall 12 may be on a plane T. The plane T may be oriented transverse to plane U, forming an angle β therebetween. For example, the angle β may be between about 45 and about 25 degrees, and most specifically the angle β may be about 35 degrees. Other suitable angles β may also be selected by a skilled artisan, as desired.

In operation, the slope-level-cut bucket 2 may be attached to a movable arm of an excavator (not shown) and may be both pivoted and rotated by an actuator 5 with at least one hydraulic piston to be presented in an orientation substantially perpendicular to the sloped excavating surface 43 to be cut. This selective orientation of the sloped-level-cut bucket 2, together with the excavating edge 40 of the cutting wall 20, has been found to minimize bucket overlap due to an optimized interaction of each bucket half 4, 6 with the sloped excavating surface 43, as shown FIGS. 6-8.

In certain excavating processes, for example, where dredging, the operator may open and close the slope-level-cut bucket 2 on a waterline to conduct a visual check of how level each stair-step 44 cuts. This ensures that the slope cutting operation will be optimized for the slope being cut in a body of water.

It should be appreciated that first bucket half 4, the second bucket half 6, and the support structure 26 may be manufactured using any method or material chosen by a skilled artisan. As a non-limiting example, the slope-level-cut bucket 2 may be manufactured using metal (such as steel, titanium, aluminum), plastic, carbon-fiber, or wood. In a specific embodiment, the slope-level-cut-bucket 2 may be formed using corresponding casting molds to create an integrally molded first bucket half 4 and second bucket half 6. In another embodiment, the first bucket half 4 and the second bucket half 6 may be created by joining a plurality of pieces or parts together, for example, by welding or other suitable manufacturing processes.

EXAMPLE

In one example, an excavator was outfitted with a five (5) cubic yard slope-level-cut bucket 2 according to the present disclosure. The excavator was a CAT 385, having a thirty-two-foot and ten-inch (32'-10") boom, and an eighteen-foot and one-inch (18'-1") stick. The slopes cut with the slope-level-cut bucket 2 ranged from average of 5H:1V to as steep as 3H:1V. The excavator then used the slope-level-cut bucket 2 to dredge material from within the body of water.

The slope-level-cut bucket 2 had the contoured footprint 42 (e.g., trapezoidal or pyramidal) as shown in FIG. 9, covering an area of 65.5 square feet. The average cut of the bucket was 2.06 feet, assuming a 5-cubic yard capacity. The actual bucket capacity was estimated to be 4.8 cubic yards, which would leave an average cut of 1.98 feet per bucket bite.

The slope-level-cut bucket 2 was employed in digging operations relative to a conventional flat-level-cut bucket as a control. Production comparisons relative to the conventional flat-level-cut bucket are shown below in TABLES 1 and 2.

TABLE 1

Volume Removed Comparison 2nd Pass Dredging in a Slope

| | Slope-Level-Cut Bucket Volume (Cubic Yards) | Conventional Clamshell Bucket Volume (Cubic Yards) |
|---|---|---|
| Gross | 5,700 | 5,260 |
| Grade (Paid) | 3,707 | 3,303 |
| 6" Allowable | 1,651 | 1,616 |
| Below 6" Allowable | 342 | 341 |
| Percent Non-Payable (6" and Below) | 34.9% | 37.2% |
| Percent (Below 6" Allowable) | 6.0% | 6.5% |

TABLE 2

Production Per NOH Comparison 2nd Pass Dredging in a Slope

| | Slope-Level-Cut Bucket Volume (Cubic Yards) | Conventional Clamshell Bucket Volume (Cubic Yards) |
|---|---|---|
| Gross | 60 | 61 |
| Grade (Paid) | 39 | 38 |
| 6" Allowable | 17 | 19 |
| Below 6" Allowable | 4 | 4 |

Advantageously, the slope-level-cut bucket 2 of the present disclosure has been found to dig slopes with a greater accuracy and efficiency than conventional flat-level-cut buckets having a rectangular footprint. The slope-level-cut bucket 2 has achieved required design depths and leaves an accurately sloped excavating surface 43.

Figure 10:
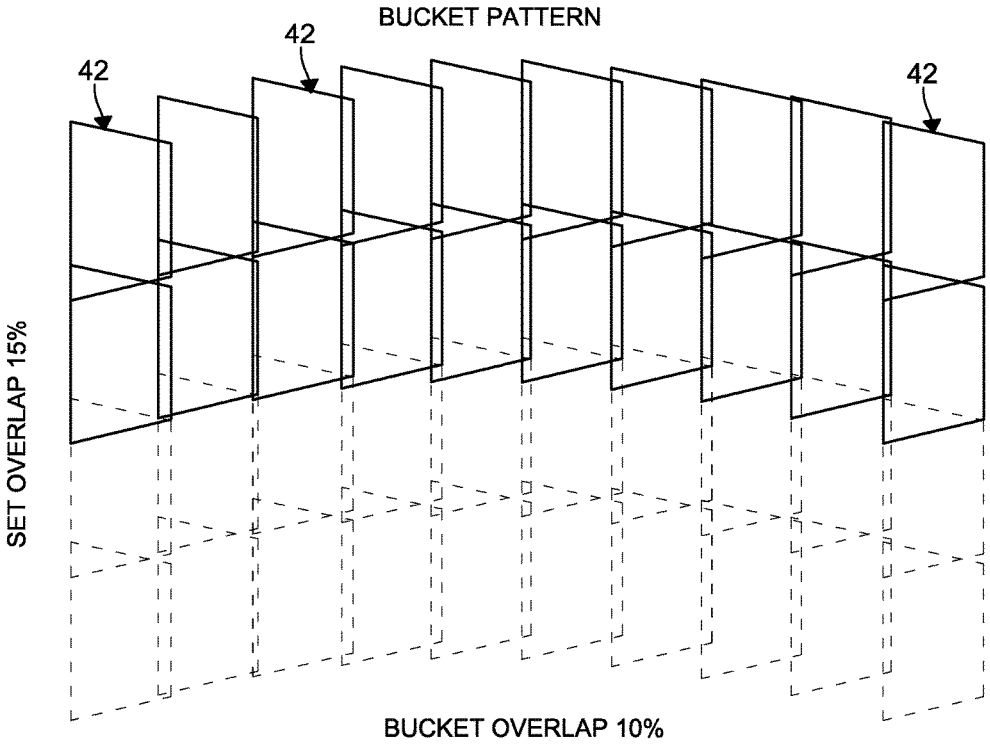
FIG. 10 is a schematic illustration depicting a bucket overlap pattern associated with use of the slope-level-cut bucket, according to certain embodiments of the disclosure.

With reference to FIG. 10, the slope-level-cut bucket 2 has also been found to have less restrictive bucket overlap percentages. In particular, the bucket overlap on sloped excavating surfaces 43 has been seen to decrease from about seventy percent (70%) for conventional flat-level-cut buckets to about ten percent (10%) with the slope-level-cut bucket 2 of the present disclosure, while still successfully achieving the required design depths.

It has also been found that there is reduced water collection with the slope-level-cut bucket 2 of the present disclosure. In particular, the number of buckets to complete a single boom set over a fifty-foot (50') wide cut-lane was shown to decrease from twenty-six (26) buckets to nine (9) buckets (i.e., a sixty-five percent (65%) increase in efficiency). The stair-stepped 44 design of the present disclosure increased bucket fill, resulting in more material and less water. The increased bucket fill significantly reduced the amount of water generation needing to be processed at a dewatering plant, once the excavated material was hauled away for processing.

The slope-level-cut bucket 2 of the present disclosure has also been shown to reduce suspension by minimizing buckets taken. In other words, the reduction in required buckets also reduced resuspension by limiting the number of times the bucket came into contact with the bottom excavating surface 43. It should be appreciated that by reducing suspension, the slope-level-cut bucket 2 is able to more efficiently remove materials than other bucket designs. The more efficient removal of materials results in fewer particles unwantedly dispersed into the body of water. Accordingly, the slope-level-cut bucket 2 of the present disclosure is able to reduce the amount of PCB contaminated sediment that is unwantedly dispensed in the water during the dredging process Finally, it has been discovered that there is no sacrifice to production with the slope-level-cut bucket 2 of the disclosure. Production between the slope-level-cut bucket 2 and the flat-level-cut bucket was observed to be almost identical. Both buckets removed approximately sixty (60) net cubic yards per operating hour. Thus, use of the slope-level-cut bucket 2 is deemed to result in no sacrifice to net production in operation.

Advantageously, the slope-level-cut bucket 2 facilitates the cutting of a sloped surface, minimizes bucket overlap where cutting the sloped surface, and allows for compliance with stringent environmental dredging requirements.

While certain representative embodiments and details have been shown for purposes of illustrating the invention, it will be apparent to those skilled in the art that various changes may be made without departing from the scope of the disclosure, which is further described in the following appended claims.

What is claimed is:

1. A slope-level-cut bucket, comprising:

a first bucket half pivotably connected to a second bucket half, the first bucket half and the second bucket half movable about a first axis between a closed position and an opened position, each of the first bucket half and the second bucket half having a top wall, a front wall, a rear wall, a side wall and a cutting wall, the cutting wall having a plurality of steps, each of the first bucket half and the second bucket half having a rim defined by the top wall, the front wall, the rear wall, and the cutting wall, and the rim of each cutting wall defining an excavating edge, wherein the first bucket half and the second bucket half are bilaterally symmetrical, and wherein the cutting wall of the first bucket half is configured to create a trapezoidal cutting footprint.

2. The slope-level-cut bucket of claim 1, further comprising an actuator configured to move the first bucket half and the second bucket half between the closed position and the opened position.

3. The slope-level-cut bucket of claim 1, wherein the first bucket half has a distal end and a proximal end, the side wall and the cutting wall of the first bucket half tapering toward the distal end.

4. The slope-level-cut bucket of claim 1, wherein the steps adjacent to the front wall of the first bucket half are of a greater length than the steps adjacent to the rear wall of the first bucket half.

5. The slope-level-cut bucket of claim 1, wherein the top wall, the front wall and the rear wall of the first bucket half are planar.

6. The slope-level-cut bucket of claim 1, wherein a reinforcing portion is secured to the cutting wall of the first bucket half.

7. The slope-level-cut bucket of claim 1, wherein at least one de-watering aperture is formed in the top wall of the first bucket half.

8. A slope-level-cut bucket, comprising:

a first bucket half pivotably connected to a second bucket half, the first bucket half and the second bucket half movable about a first axis between a closed position and an opened position, each of the first bucket half and the second bucket half having a top wall, a front wall, a rear wall, a side wall and a cutting wall, the cutting wall having a plurality of steps, each of the first bucket half and the second bucket half having a rim defined by the top wall, the front wall, the rear wall, and the cutting wall, and the rim of each cutting wall defining an excavating edge, wherein the first bucket half and the second bucket half are bilaterally symmetrical, and wherein a first height of the front wall is less than a second height of the rear wall.

9. The slope-level-cut bucket of claim 8, wherein the first bucket half has a corner defined by a portion of a curvilinear surface of the side wall disposed adjacent to the top wall.

10. The slope-level-cut bucket of claim 8, wherein the rear wall of the first bucket half is on a first plane and the excavating edge of the first bucket half is on a second plane, the first plane oriented transverse to the second plane and defining a first angle therebetween.

11. The slope-level-cut bucket of claim 10, wherein a planar surface of the side wall of the first bucket half is on a third plane and the top wall of the first bucket half is on fourth plane, the third plane oriented transverse to the fourth plane and defining a second angle therebetween.

12. The slope-level-cut bucket of claim 11, wherein the second angle is between about 25 degrees and about 45 degrees.

13. A slope-level-cut bucket, comprising:

a first bucket half pivotably connected to a second bucket half, the first bucket half and the second bucket half movable about a first axis between a closed position and an opened position, each of the first bucket half and the second bucket half having a top wall, a front wall, a rear wall, a side wall and a cutting wall, the cutting wall having a plurality of steps, each of the first bucket half and the second bucket half having a rim defined by the top wall, the front wall, the rear wall, and the cutting wall, and the rim of each cutting wall defining an excavating edge, wherein the first bucket half and the second bucket half are bilaterally symmetrical, wherein the rear wall of the first bucket half is on a first plane and the excavating edge of the first bucket half is on a second plane, the first plane oriented transverse to the second plane and defining a first angle therebetween, and wherein the first angle is between about 72 degrees and about 79 degrees.

14. A slope-level-cut bucket, comprising:

a first bucket half pivotably connected to a second bucket half, the first bucket half and the second bucket half movable about a first axis between a closed position and an opened position, each of the first bucket half and the second bucket half having a top wall, a front wall, a rear wall, a side wall and a cutting wall, the cutting wall having a plurality of steps, each of the first bucket half and the second bucket half having a rim defined by the top wall, the front wall, the rear wall, and the cutting wall, and the rim of each cutting wall defining an excavating edge, wherein the rear wall of the first bucket half and the second bucket half is on a first plane and the excavating edge of the first bucket half and the second bucket half is on a second plane, the first plane oriented transverse to the second plane, defining a first angle therebetween, the first angle between about 72 degrees and about 79 degrees, and wherein a planar surface of the side wall of the first bucket half and the second bucket half is on a third plane and the top wall of the first bucket half and the second bucket half is on fourth plane, the third plane oriented transverse to the fourth plane, defining a second angle therebetween, and the second angle between about 25 degrees and about 45 degrees.

15. A slope-level-cut bucket, comprising:

a first bucket half pivotably connected to a second bucket half, the first bucket half and the second bucket half movable about a first axis between a closed position and an opened position, each of the first bucket half and the second bucket half having a top wall, a front wall, a rear wall, a side wall and a cutting wall, the cutting wall having a plurality of steps, the steps adjacent to the front wall of the first bucket half and the second bucket half being of a greater length than the steps adjacent to the rear wall of the first bucket half and the second bucket half, the first bucket half and the second bucket half having a rim defined by the top wall, the front wall, the rear wall, and the cutting wall, and the rim of each cutting wall defining an excavating edge, the first bucket half and the second bucket half each having a distal end and a proximal end, the side wall and the cutting wall of the first bucket half and the second bucket half tapering toward the distal end of the first bucket half and the second bucket half, wherein the rear wall of the first bucket half and the second bucket half is on a first plane and the excavating edge of the first bucket half and the second bucket half is on a second plane, the first plane oriented transverse to the second plane, defining a first angle therebetween, the first angle between about 72 degrees and about 79 degrees, and wherein a planar surface of the side wall of the first bucket half and the second bucket half is on a third plane and the top wall of the first bucket half and the second bucket half is on fourth plane, the third plane oriented transverse to the fourth plane, defining a second angle therebetween, and the second angle between about 25 degrees and about 45 degrees.

* * * * *